US005687586A

United States Patent [19]

Facini

[11] Patent Number: 5,687,586

[45] Date of Patent: Nov. 18, 1997

[54] INTERCONNECTABLE JEWELRY SETTING FOR THE CONSTRUCTION OF JEWELRY PIECES

[76] Inventor: Sam Facini, 613 Knollwood Rd., Franklin Lakes, N.J. 07417

[21] Appl. No.: 674,101

[22] Filed: Jul. 1, 1996

[51] Int. Cl.[6] ..... A44C 17/02

[52] U.S. Cl. ..... 63/26; 63/28

[58] Field of Search ..... 63/26, 27, 29.1, 63/30, 31, 28, 3; 59/80, 82

[56] References Cited

U.S. PATENT DOCUMENTS 4,781,038 11/1988 Branca et al. ..... 63/28 X 5,343,718 9/1994 Pöll ..... 63/26

*Primary Examiner*—Kien T. Nguyen

*Attorney, Agent, or Firm*—Brian L. Wamsley

[57] ABSTRACT

The invention relates to an interconnectable jewelry setting for connecting with other interconnectable jewelry settings to form a jewelry piece such as a bracelet, necklace, earrings, or other ornamental item. The jewelry setting comprises a frame formed from stamped sheet metal, in which a gemstone is mounted, a ball-link joint, which is connectable to similar jewelry settings to form the desired jewelry piece without the need for soldering or welding. The ball-link joint is held in place by a key-lock clip opening in the setting frame, and a spring insert attached to the internal end of the ball-link joint provides tension against the joint and allows for elasticity and flexibility of the jewelry piece. A snap-on cover on the base of the setting frame provides additional structural support to the frame.

20 Claims, 2 Drawing Sheets

Fig. 3
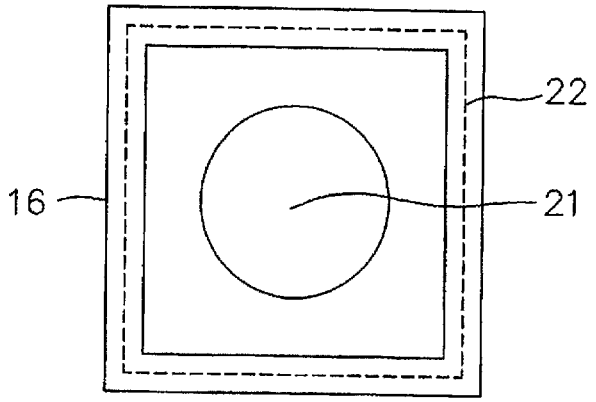
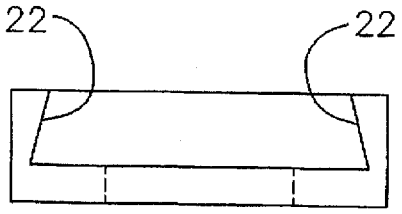
Fig. 4
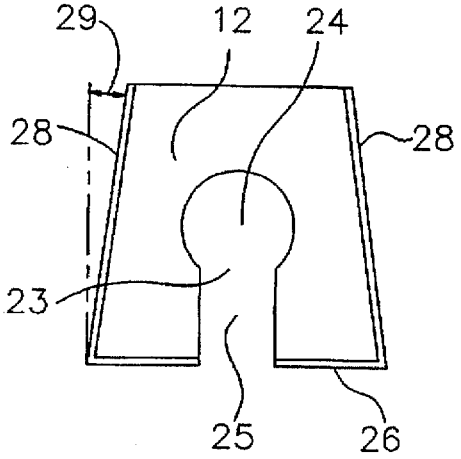
Fig. 5
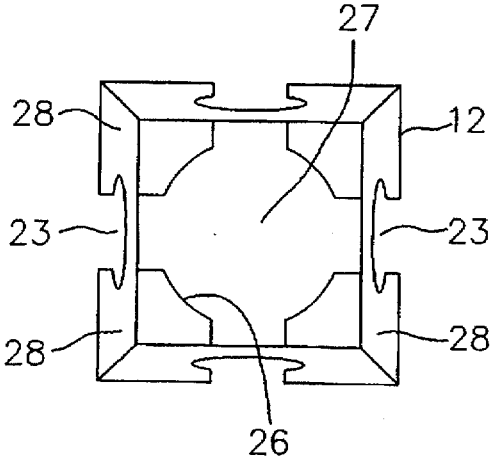
Fig. 6

INTERCONNECTABLE JEWELRY SETTING FOR THE CONSTRUCTION OF JEWELRY PIECES

The present invention relates to an interconnectable jewelry setting for connecting with other interconnectable jewelry settings to form a jewelry piece such as a bracelet, necklace, earrings, or other ornamental item. In particular, the invention relates to a jewelry setting comprising a frame formed from stamped sheet metal, in which a gemstone is mounted, and which is connectable to similar jewelry settings through a ball-link joint to form the desired jewelry piece, without the need for soldering or welding. The ball-link joint is held in place by a key-lock clip opening in the setting frame. An internal spring insert attached to the internal end of the ball-link joint provides tension against the joint and allows for elasticity and flexibility of the jewelry piece. A snap-on cover on the base of the setting frame provides additional structural support to the frame.

BACKGROUND OF THE INVENTION

Heretofore, the manufacture of jewelry pieces having many interconnected settings containing mounted gemstones was a tedious and time-consuming process which required many hours of manual labor by skilled technicians. This was due to the fact that the individual jewelry settings were maufactured as castings from molten precious metal, commonly gold, silver or platinum. Casting made the settings extremely ridged (non-flexible), and very crude. Depending on the quality of the casting, the setting while in this state was not always usable.

Inserting the gemstone into a cast setting first required preparation by skilled and experienced technicians. The cast gemstone setting had to be manually trimmed and shaped for gemstone insertion. Only after careful trimming and shaping could the gemstone be mounted into the setting by pushing and forcing the gemstone into place. Often, metal of the setting was lost upon abrasion by the stone during the setting process resulting in a substandard setting where the gemstone would be loose. If immediate Corrective action was not taken, a lost gemstone would result.

Further, each setting would then be hand-soldered or welded to the next contiguous setting or settings. Additional individual settings were added by the same welding or soldering process, forming single or multiple rows until the number of desired settings for the individual jewelry piece was connected. After the desired number of settings was joined, the gemstones would be mounted. Often, as in the case of bracelets and necklaces, many hundreds of settings are needed, requiring weeks of manual labor to complete the piece. This labor added enormously to the price of the jewelry piece to the consumer and often exceeded the value of the stones and precious metal used in the piece.

Accordingly, it is desirable to construct a jewelry setting that would eliminate hand-soldering or welding, facilitate a quick, inexpensive assembly process requiring only a minimum of skill by the worker, require only very basic assembly and magnification tools, and facilitate the mounting of the gemstones. The linkage between the settings should also result in an overall flexibility of the finished jewelry piece, greater than that achieved by established linkage processes.

It is also desirable that the jewelry setting be amenable to easy manufacture on a commercial scale, without the necessity of casting each individual setting.

SUMMARY OF THE INVENTION

It is therefore an object of the present invention to provide a jewelry setting which can be easily connected to one or more similar settings without the need for welding or soldering, thus substantially reducing the labor time in fabricating an individual jewelry piece, and therefore reduce the cost of the piece. By eliminating the need for welding or soldering, the linkage mechanism joining the jewelry settings of the invention also provide for a more flexible jewelry piece. It is a further object of the invention to provide a jewelry setting which substantially facilitates the mounting of the gemstone.

Another object of the invention is to provide a jewelry setting that can be more easily manufactured in commercial quantities by not requiring casting from molten metal.

In accordance with the invention, an interconnectable jewelry setting having a frame fabricated from sheet metal, preferably in the form of a cube or box for mounting the gemstone is provided. A gemstone retaining track is formed on the collar of the frame for mounting of the gemstone. The retaining track is insertable into preformed grooves in the gemstone, and is manufactured to have a certain metal memory, which will hold the gemstone.

The jewelry setting is connectable to similar jewelry settings by means of a ball-link joint. The number of settings to be joined together is determined by the shape of the setting and the position to be occupied in the jewelry piece by the individual setting. For example, if the individual jewelry setting was square and was to be located at the edge of a multi-row jewely piece such as a bracelet, it would be connected with three contiguous settings. If the setting was to be located in an internal row of the bracelet, it would be surrounded by and connected with four other settings. If a single row jewelry piece is desired, the setting would be connected with only two similar settings; on opposite sides.

The ball-link joint consists of a shaft having a "ball" on each end. A key-lock clip opening is located on at least one side of the frame for insertion of the ball-link joint. The key-lock clip opening consists of a circular opening in the side of the frame, having a diameter larger than the diameter of the shaft of the ball-link joint. A narrowing wedge-shaped slot extends from the base of the frame to the circular opening in the frame side to allow insertion of the shaft of the joint, which is "snapped" into position. The key-lock clip opening is designed so that, once inserted, the ball-link joint cannot be removed without causing permanent damage to the frame.

A spring insert is located inside the frame which retains the ball-link joint inserted into the key-lock clip opening. The spring insert also contains a slot similar in shape to the key-lock clip opening, which is placed around the shaftd of the ball-link joint inside the setting frame. The spring insert further locks the joint into the frame while also exerting tension, because of its metal memory, on the ball-link joint in a direction toward the center of the setting. This tension provides the elastic and flexible nature of the jewelry piece.

The setting frame also has a base onto which a snap-on cover is placed. The cover, in the shape of the setting frame, is provided with an internal bevel which matches the external bevel of the base, on which the cover is snapped into place. An opening is located in the cover which allows light to pass through to the gemstone, further enhancing the beauty of the jewelry piece.

BRIEF DESCRIPTION OF THE DRAWINGS

FIG. 3 is a top view of the cover piece of the jewelry setting;

FIG. 4 is a side cross-sectional view of the cover piece of FIG. 3;

FIG. 5 is a side view the spring insert; and

FIG. 6 is a top view of the spring insert.

DETAILED DESCRIPTION OF THE INVENTION

Figure 1:
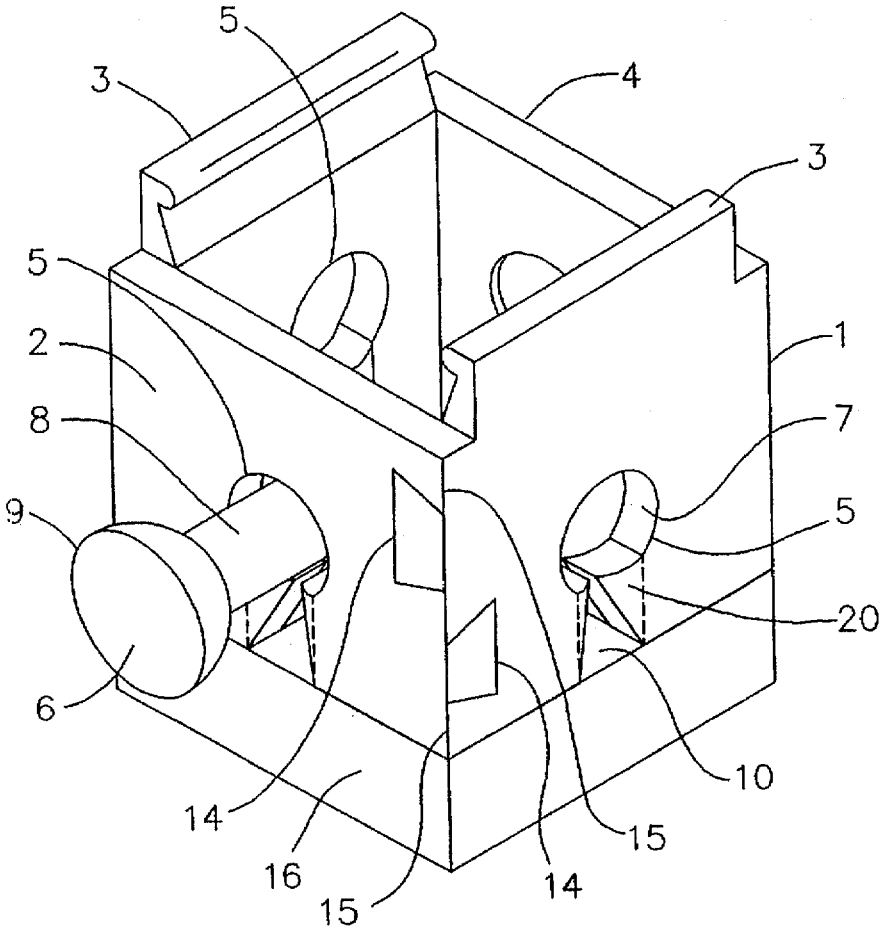
FIG. 1 is a perspective view of the jewelry setting in accordance with the present invention.

Referring to the perspective view of FIG. 1 depicting the jewelry setting 1 of the present invention as assembled, a setting frame 2 is shown in a four-sided cubic form and having gem retaining tracks 3 on two opposing sides of the frame 2. It is also contemplated that gem retaining tracks 3 could be placed on three or four sides of the frame. In addition, the frame could be of any shape, even round or oval, and have as many sides as necessary and practicable, from triangular to octagonal or more. The gem retaining tracks 3 are located above a collar portion 4 of the frame, and at a height sufficient to allow for flexibility of the tracks to move slightly backward to receive and accommodate the gemstone (not shown) during the insertion process, and then lock the gemstone into position. For example, for gemstones of a standard 0.1" (2.5 mm) size, the gem retaining tracks 3 should sit approximately 0.020" above the collar 4.

On the side of the setting frame 2 is shown a key-lock clip opening 5, for securing one end of a ball-link joint 6. For the square frame illustrated, there may be as many as four key-lock clip openings, depending on the desired number of jewelry settings to be joined. These openings 5 are located on the sides of the setting frame 2, and are generally spaced equally apart—for the embodiment shown, the separation would be about 90° apart. The ball-link joint 6 provides a linkage mechanism between the jewelry setting and the next contiguous jewelry setting. This is accomplished by inserting one "ball" end of the joint into the key-lock clip opening 5 of each setting.

The key-lock dip opening 5 consists of a circular portion 7 placed substantially near the center of the side of setting frame 2, and having a diameter slightly larger than the diameter of the shaft 8 of the ball-link joint 6, but substantially smaller than the ball end 9, 13 of the joint 6. Extending from the circular portion 7 of the key-lock clip opening 5, a wedge-shaped slot 10 extends downward and continuing through the base 11 (see FIG. 2) of the setting frame 2. At the circular portion 7 of the opening 5, the width of slot 10 is slightly smaller than the diameter of the shaft 8 of ball-link joint 6. On either side of slot 10 is a flange 20 which becomes folded inwardly as shaft 8 of the ball-link joint is inserted, locking in the shaft. Slot 10 widens as it extends towards base 11 until it attains a width slightly exceeding the diameter of shaft 8. By this design, shaft 8 may be inserted into slot 10 from the bottom of base 11, and snapped into opening 7. After being forced through the narrow portion of slot 10, shaft 8 becomes locked into circular opening 7 of key-lock clip opening 5. Further, shaft 8 cannot be reversibly removed without causing damage to shaft 8 or the flanges 20 of slot 10. In addition, after ball-link joint 6 has been inserted into circular opening 7, a spring insert 12 (see FIG. 2) is installed inside setting frame 2 and around the internal ball end 13 of joint 6, which further secures joint 6 and provides elasticity and flexibility to the jewelry piece. Alternatively, the spring insert may be pre-installed in the frame prior to snapping the joint into the key-lock dip opening.

In the preferred embodiment, setting frame 2 is manufactured from sheet metal made from the metal to be used in the finished jewelry piece. Commonly, the metal chosen is a precious metal such as gold, platinum or silver, but any non-precious or base metal can also be used, either plated or unplated. Each individual jewelry setting is manufactured from the sheet metal by first stamping from the sheet a single flat form which is then folded to form the four sides of setting frame 2. Alternatively, the same result could be accomplished with slight modification to the fabrication process, by metal drawing. Gem retaining tracks 3 and key-lock clip openings 7 may also be formed into the flat form during the stamping process. The coining process leaves the metal hard but flexible and having a metal memory, which is required to keep the gem securely fastened in its place. It is contemplated that only a single stamping step would be necessary to fabricate the desired flat form. At each end of the stamped form are optionally located either an opening or a dovetail tab 14 which can be connected to join the ends 15 of the single flat form after folding.

To further secure the ends 15 of the folded single flat form of the setting frame 2 and to provide structural support to the finished setting 1, a cover 16 is provided around base 11 of setting frame 2 by snappable attachment.

Although the four-sided cubic form is preferred, the shape of the jewelry link is not limited to four sides or four sides of equal width, but can be modified to accomodate all varieties of settings and shapes of gemstones. For example, gemstones may be either square, round, oval, pear-shaped, marquis, emerald cut, hexagonal, triangular or baguette. The jewelry link can be designed to simulate all settings, such as prong, channel, burnish or invisible.

The gem retaining track 3 is designed with precise dimensions and tolerances to accomodate gemstones specifically cut for the purpose. For example, gemstones cut for disappearing or invisible settings could be readily used. Such pre-cut gemstones are commercially available in various standard industry sizes, a common size being on the order of 2.5 mm (0.100") for the gemstone. The jewelry setting is not limited to this size but can be made of almost any size to accommodate larger or smaller gemstones as required.

Figure 2:
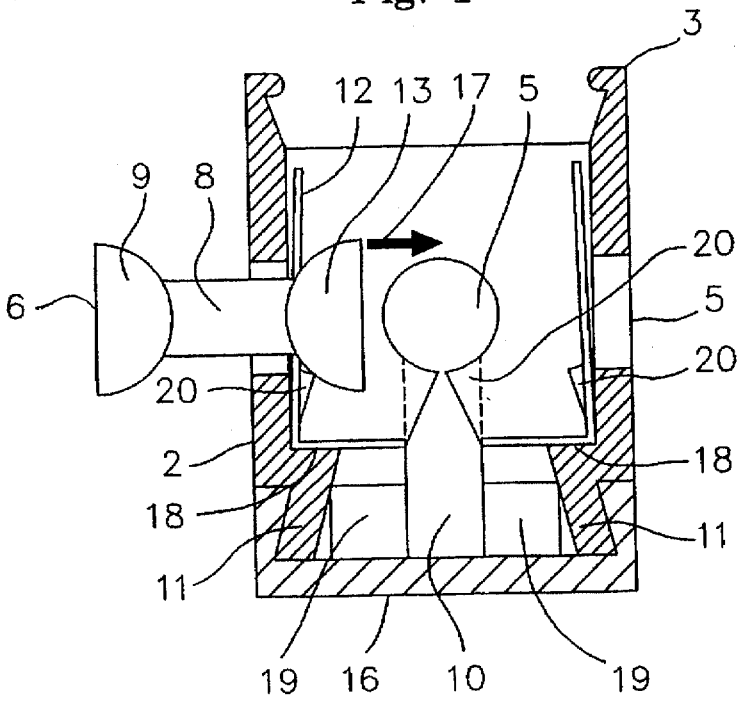
FIG. 2 is a side cross-sectional view of the fully assembled jewelry setting.

FIG. 2 shows a cross-sectional view of the fully assembled jewelry setting 1, illustrating the internal parts. As can be seen from FIG. 2, in its inserted position, ball-link joint 6 extends through the wall of setting frame 2, and also through one side of spring insert 12. The spring insert 12 exerts tension against joint 6 through contact with the internal ball-end 13, in the direction of arrow 17. As can be seen from FIG. 2, spring insert 12 rests on an internal "shelf" 18 formed above the frame base 11 which extends along the inside perimeter of setting frame 2. Extending downward and in an outward diagonal direction from shelf 18 is the frame base 11. Because of slots 10 extending downward from the circular portion 7 of key-lock clip opening 5, base 11 consists of two component tabs 19 for each side of the setting frame, for a total of eight tabs. Cover 16 is shown as attached to base 11.

In the preferred embodiment, ball-link joint 6 is cylindrical in shape, having two hemispherical balls 9, 13 on each end. However, the ball-link joint is not limited to this configuration, but could have almost any desired shape such as, but not limited to, square, octagonal, hexagonal or oval.

FIG. 3 shows a top view of cover 16, which is in the shape of the jewelry setting to be obtained. As shown, cover 16 is square because in the preferred embodiment the jewelry setting is square. An opening 21 is located in the cover 16 to allow light to pass through the setting and therefore the gemstone from the bottom. The opening 21 is shown as circular, but any desired shape is contemplated. The inside of the sides of cover 16, FIG. 4, are slightly diagonally angled to correspond to the angle of base 11. As the cover 16 is snapped into position onto base 11, the tab portions 19 of base 11 are elastically depressed and when cover 16 is in position, snap back and exert pressure against the inside angle 22 of cover 16. The pressure as well as the diagonal angle hold cover 16 into position. Cover 16 is preferrably made from the same metal as setting frame 2, but could also be made from any other metal desired.

FIG. 5 is a side view of spring insert 12 as ready to be inserted into setting frame 2, not shown. As in the preferred embodiment, spring insert 16 is square in shape, as more easily seen in FIG. 6, and has on each side a slotted opening 23 which substantially matches the key-lock clip opening 5 of setting frame 2. Slotted opening 23 has a circular portion 24 and a slotted portion 25, and is meant to be inserted in the setting frame from the open top portion of frame 2 in a downward motion. In the operation of inserting spring insert 12, it can be appreciated that slotted opening 23 becomes positioned around shaft 8 of ball-link joint 6, of which internal ball 13 is secured inside spring insert 12. As seen from the top view of the spring insert in FIG. 6, the bottom 26 of the insert also has a circular opening 27 corresponding to the opening in the cover 16 for letting in fight. Also shown by FIG. 6, the sides 28 are directed toward the center at an angle 29.

The spring insert is manufactured in a manner similar to the setting frame, i.e., by stamping from a flat piece of sheet metal. The design of the stamped flat metal piece for forming the spring insert would be appreciated by one having skill in the art from viewing FIGS. 5 and 6. In the preferred embodiment, the form of the spring insert would have a square base from which the four sides would be extended, such that the sides may be folded into an angle from the base substantially less than 90°. The sides would be slightly tapered so that when the are fully folded and in contact with each other, angle 29 is formed. Sides 28 are not joined along their edges, as this would defeat the nature of the spring.

It is contemplated that spring inert 12 and ball-link joint 6 be made of hardened material, at least harder that the metal used in the setting frame, that has been treated to achieve and maintain spring properties over time. These components should also withstand wear since there is a rubbing action between the spring and the joint. Examples of such metals are beryllium copper alloy 172, HT or beryllium nickel alloy, or any metal of similar qualitites.

While the present invention has been explained in relation to its preferred embodiment, it is to be understood that various modifications thereof will be apparent to those skilled in the art upon reading this specification. The invention disclosed herein is therefore intended to cover all such modifications that fall within the scope of the appended claims.

What is claimed is:

1. A jewelry setting which is interconnectable with other jewelry settings to form a jewelry piece without the need for soldering or welding, comprising;

a frame for mounting a gemstone, formed from a stamped, sheet metal piece having two ends which are joined together, said frame comprising an upper collar portion, a bottom portion and at least one side;

a ball link joint inserted into the side of the frame, comprising a shaft and two ball ends, for connecting two contiguous jewelry settings by inserting one of the ball ends into the side of each of the two contiguous jewelry setting frames;

a key-lock clip opening located in the side of the frame for receiving the shaft of the ball-link joint and retaining the ball end of the ball-link joint; and a cover in the shape of the frame, attached to the bottom portion of the frame to provide additional structural support to the frame.

2. The jewelry setting of claim 1 further comprising means for mounting a gemstone in the frame of the jewelry setting.

3. The jewelry setting of claim 2 wherein said means for mounting the gemstone comprises a gemstone retaining track on the upper collar portion of the frame.

4. The jewelry setting of claim 1 further comprising a spring insert located within the frame and positioned around the shaft of the ball-link joint to further retain the ball-link joint and to provide tension on the ball-link joint.

5. The jewelry setting of claim 4 wherein the spring insert further comprises an opening having a shape similar to the key-lock clip opening for positioning around the shaft of the ball-link joint.

6. The jewelry setting of claim 4 wherein the spring insert is made from a metal selected from the group consisting of beryllium copper alloy 172 and beryllium nickel alloy.

7. The jewelry setting of claim 1 further comprising more than one key-lock clip opening and more than one ball-link joint, for interconnecting the jewelry setting with more than one contiguous jewelry setting.

8. The jewelry setting of claim 1 wherein the key-lock clip opening is configured to snappably receive the ball-link joint, which is snappably inserted therein.

9. The jewelry setting of claim 1 wherein the key-lock dip opening further comprises flanges which deform upon the insertion of the shaft of the ball-link joint, locking the ball-link joint in place.

10. The jewelry setting of claim 1 wherein the ends of the stamped, sheet metal piece comprise joining means that do not require welding or soldering.

11. The jewelry setting of claim 10 wherein said joining means are comprised of dovetail fittings.

12. The jewelry setting of claim 1 wherein the bottom portion of the frame further comprises means for the snappable attachment of the cover.

13. The jewelry setting of claim 1 wherein an opening is provided in the cover to allow light to pass to illuminate the gemstone from the bottom.

14. The jewelry setting of claim 1 wherein the shape of the frame is triangular, square, rectangular, pentagonal, hexagonal, octagonal, round, oval, pear-shape or marquis.

15. The jewelry setting of claim 1, fabricated of a metal selected from the group, gold, slver, platinum or alloys therof.

16. A jewelry setting which is interconnectable with other jewelry settings to form a jewelry piece without the need for soldering or welding, comprising;

a frame for mounting a gemstone, comprising an upper collar portion, a bottom portion and at least one side;

a ball-link joint inserted into the side of the frame, comprising a shaft and two ball ends, for connecting two contiguous jewelry settings by inserting one of the ball ends into the side of each of the two contiguous jewelry setting frames; and a key-lock dip opening located in the side of the frame for receiving the shaft of the ball-link joint and retaining the ball end of the ball-link joint.

17. The jewelry setting of claim 16, further comprising a spring insert located within the frame and positioned around the shaft of the ball-link joint to further retain the ball end and to provide tension on the ball-link joint.

18. The jewelry setting of claim 16, further comprising a cover in the shape of the frame and attached to the bottom portion of the frame, to provide additional structural support to the frame.

19. A jewelry piece constructed from jewelry settings which are interconected without being welded or soldered, each of said jewelry settings comprising;

a frame for mounting a gemstone, formed from a stamped, sheet metal piece having two ends which are joined together, said frame comprising an upper collar portion, a bottom portion and at least one side;

means for mounting the gemstone in the frame of the jewelry setting;

at least one ball-link joint inserted into the sides of the frame, comprising a shaft and two ball ends, for connecting two contiguous jewelry settings by inserting one of the ball ends into the side of each of the two contiguous jewelry setting frames;

at least one key-lock clip opening located in the sides of the frame for receiving the shaft of the ball-link joints and retaining the ball end of the ball-link joints;

a spring insert located within the frame and positioned around the shaft of the ball-link joint to further retain the ball-link joint and to provide tension on the ball-link joint; and a cover in the shape of the frame, attached to the bottom portion of the frame to provide additional structural support to the frame.

20. The jewelry setting of claim 1 wherein the frame is formed from sheet metal by the process of drawing.

* * * * *